US007151501B2

(12) United States Patent
Tran

(10) Patent No.: US 7,151,501 B2
(45) **Date of Patent: *Dec. 19, 2006**

(54) MICROELECTROMECHANICAL SWITCH (MEMS) ANTENNA

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 2 days.

This patent is subject to a terminal disclaimer.

(21) Appl. No.: 10/371,792

(22) Filed: Feb. 21, 2003

(65) Prior Publication Data

US 2004/0164905 A1 Aug. 26, 2004

(51) Int. Cl.
*H01Q 1/38* (2006.01)

(52) U.S. Cl. ..... 343/823; 343/876

(58) Field of Classification Search ..... 343/700 MS, 343/745, 793, 795, 823, 876, 905
See application file for complete search history.

(56) References Cited

U.S. PATENT DOCUMENTS 6,061,025 A * 5/2000 Jackson et al. ..... 343/700 MS
6,417,807 B1 * 7/2002 Hsu et al. ..... 343/700 MS
6,888,505 B1 * 5/2005 Tran ..... 343/702

* cited by examiner

*Primary Examiner*—Michael C. Wimer

(57) ABSTRACT

A MEMS antenna is provided comprising a dielectric layer, and a conductive line radiator formed overlying the dielectric layer including at least one selectively connectable MEMS conductive section to vary the mechanical (physical) length of the radiator. The antenna may include a plurality of selectively connectable MEMS conductive sections and a plurality of fixed-length conductive section. The MEMS conductive sections may be parallely aligned along the radiator width, and/or parallely aligned along the radiator length. For example, the radiator may have a first length formed in response to connecting a first MEMS conductive section, and a second length, shorter than the first length, formed in response to disconnecting the first MEMS conductive section. Then, the radiator first length would be an effective quarter-wavelength odd multiple at a first frequency, and the second length would be an effective quarter-wavelength odd multiple at a second frequency.

14 Claims, 16 Drawing Sheets

MICROELECTROMECHANICAL SWITCH (MEMS) ANTENNA

BACKGROUND OF THE INVENTION

1. Field of the Invention

This invention generally relates to wireless communications antennas and, more particularly, to a selectable operating frequency antenna formed from a microelectromechanical switch.

2. Description of the Related Art

The size of portable wireless communications devices, such as telephones, continues to shrink, even as more functionality is added. As a result, the designers must increase the performance of components or device subsystems while reducing their size, or placing these components in less desirable locations. One such critical component is the wireless communications antenna. This antenna may be connected to a telephone transceiver, for example, or a global positioning system (GPS) receiver.

Wireless telephones can operate in a number of different frequency bands. In the US, the cellular band (AMPS), at around 850 megahertz (MHz), and the PCS (Personal Communication System) band, at around 1900 MHz, are used. Other frequency bands include the PCN (Personal Communication Network) at approximately 1800 MHz, the GSM system (Groupe Speciale Mobile) at approximately 900 MHz, and the JDC (Japanese Digital Cellular) at approximately 800 and 1500 MHz. Other bands of interest are GPS signals at approximately 1575 MHz and Bluetooth at approximately 2400 MHz.

Typically, better communication results are achieved using a whip antenna. Using a wireless telephone as an example, it is typical to use a combination of a helical and a whip antenna. In the standby mode with the whip antenna withdrawn, the wireless device uses the stubby, lower gain helical coil to maintain control channel communications. When a traffic channel is initiated (the phone rings), the user has the option of extending the higher gain whip antenna. Some devices combine the helical and whip antennas. Other devices disconnect the helical antenna when the whip antenna is extended. However, the whip antenna increases the overall form factor of the wireless telephone.

It is known to use a portion of a circuitboard, such as a dc power bus, as an electromagnetic radiator. This solution eliminates the problem of an antenna extending from the chassis body. Printed circuitboard, or microstrip antennas can be formed exclusively for the purpose of electromagnetic communications. These antennas can provide relatively high performance in a small form factor. However, a wireless device that is expected to operate at a plurality of different frequencies may have difficulty housing a corresponding plurality of microstrip antennas. Even if all the microstrip antennas could be housed, the close proximity of the several microstrip antennas may degrade the performance of each antenna.

FIG. 19 is a schematic diagram of a microelectromechanical switch (MEMS) (prior art). A MEMS is a semiconductor integrated circuit (IC) with an overlying mechanical layer that operates as a selectable connectable switch. That is, the underlying solid-state layer creates a field that can cause an overlying conductive material to move, permitting the conductive material to act as miniature single-pull single-throw switch. MEMS concepts were developed in labs in the 1980's and are just now beginning to be fabricated as practical products. As a result, the particular specifications and features of a MEMS are still under development. MEMS technology offers the possibility of extremely low loss switches miniature switches.

In communications applications, switches are often designed with semiconductor elements such as transistors or pin diodes. At microwave frequencies, however, these devices suffer from several shortcomings. PIN diodes and transistors typically have an insertion loss greater than 1 dB, which is the loss across the switch when the switch is closed. Transistors operating at microwave frequencies tend to have an isolation value of under 20 dB. This allows a signal to "bleed" across the switch even when the switch is open. PIN diodes and transistors have a limited frequency response and typically only respond to frequencies under 20 GHz. In addition, the insertion losses and isolation values for these switches varies depending on the frequency of the signal passing through the switches. These characteristics make semiconductor transistors and pin diodes a poor choice for switches in microwave applications.

As noted in U.S. Pat. No. 6,440,767 (Loo et al.), a microwave MEMS can be made utilizing an armature design. One end of a metal armature is affixed to an output line, and the other end of the armature rests above an input line. The armature is electrically isolated from the input line when the switch is in an open position. When a voltage is applied to an electrode below the armature, the armature is pulled downward and contacts the input line. This creates a conducting path between the input line and the output line through the metal armature. This switch provides only a single-pole, single-throw (SPST) function, that is, the switch is either open or closed.

A SPST MEMS switch can be formed from a multiple-layer armature with a suspended biasing electrode and a conducting transmission line affixed to the structural layer of the armature. A conducting dimple is connected to the conducting line to provide a reliable region of contact for the switch. The switch is fabricated using silicon nitride as the armature structural layer and silicon dioxide as a sacrificial layer supporting the armature during fabrication.

A MEMS switch suitable for RF or microwave applications typically can have a very low insertion loss (less than 0.2 dB at 45 GHz) and a high isolation when open (greater than 30 dB) over a large bandwidth, as compared to semiconductor transistors and pin diodes. These characteristics give the MEMS switch the potential to not only replace traditional narrow-bandwidth PIN diodes and transistor switches in microwave circuits, but to create a whole new class of high performance and compact microwave switch circuits. RF signals often must be switched between two destinations, such as when switching an RF signal between a first antenna array and a second antenna array. Switches that support this configuration are classified as single-pole, double-throw (SPDT) switches.

It would be advantageous if a single wireless communications telephone antenna could be made to operate at a plurality of frequencies.

It would be advantageous if MEMS could be used as part of a microstrip antenna to modify the length of the radiator.

SUMMARY OF THE INVENTION

The present invention provides a microstrip, or printed circuitboard antenna that is made with MEMS to vary the actual physical length of the printed line radiators. The MEMS can be used to form selectable connected conductive sections that vary the length of the antenna radiator, thereby changing the antenna operating frequency.

Accordingly, a MEMS antenna is provided comprising a dielectric layer, and a conductive line radiator formed overlying the dielectric layer including at least one selectively connectable MEMS conductive section to vary the mechanical (physical) length of the radiators The antenna may include a plurality of selectively connectable MEMS conductive sections and a plurality of fixed-length conductive sections. The MEMS conductive sections may be parallely aligned along the radiator width, and/or parallely aligned along the radiator length.

For example, the radiator may have a first length formed in response to connecting a first MEMS conductive section, and a second length, shorter than the first length, formed in response to disconnecting the first MEMS conductive section. Then, the radiator first length would be an effective quarter-wavelength odd multiple at a first frequency, and the second length would be an effective quarter-wavelength odd multiple at a second frequency.

Details of MEMS dipole, monopole, and patch antennas are provided below. A method for selecting an antenna length using MEMS conductive sections is also provided.

DETAILED DESCRIPTION OF THE PREFERRED EMBODIMENTS

Figure 1:
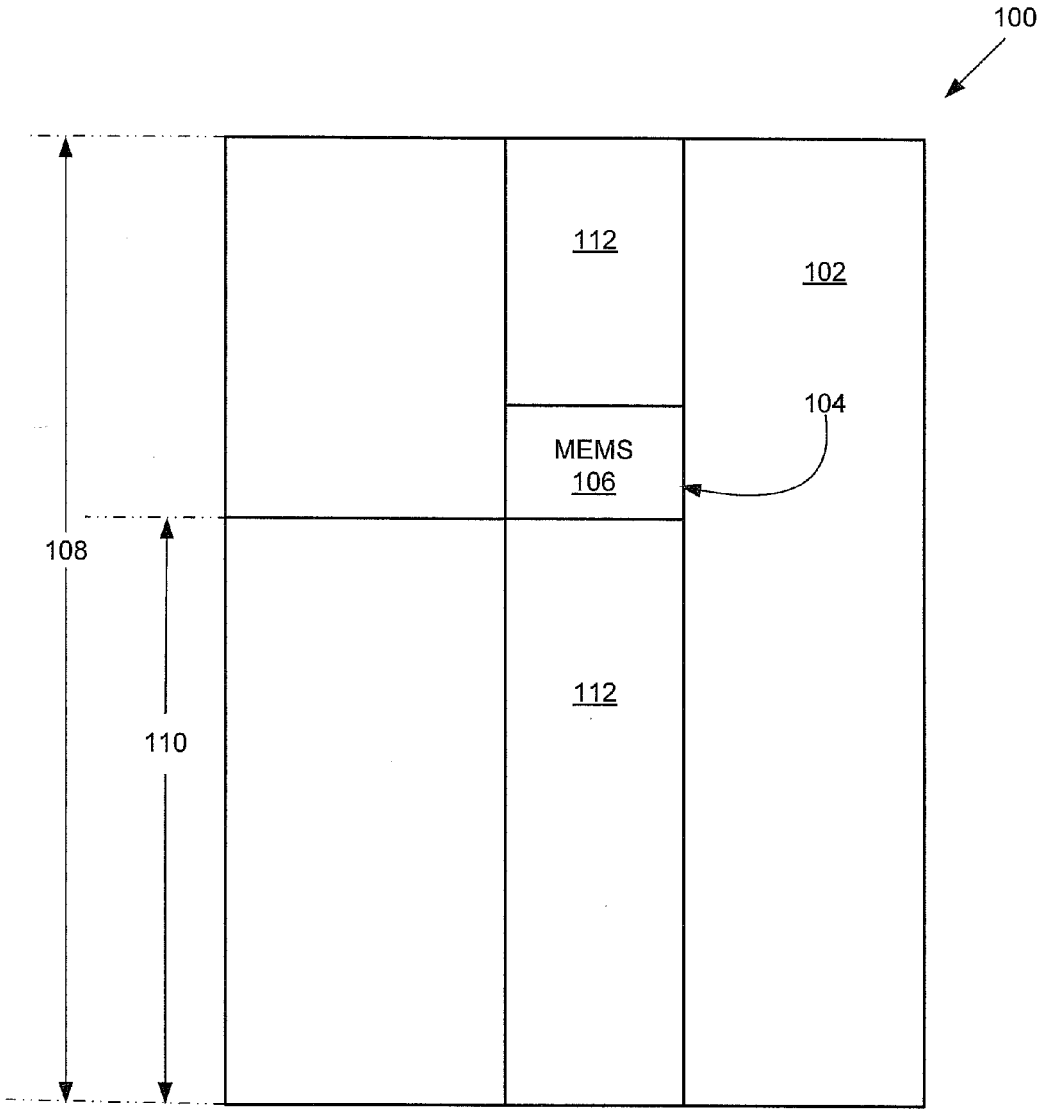
FIG. 1 is a plan view of a section of the present invention microelectromechanical switch (MEMS) antenna.

FIG. 1 is a plan view of a section of the present invention microelectromechanical switch (MEMS) antenna. General details of a MEMS antenna are initially provided, and it should be understood that the general concepts are applicable to a broad range of printed circuitboard or microstrip antennas. Details of specific dipole, monopole, and patch antennas follow.

The MEMS antenna 100 comprises a dielectric layer 102 and a conductive line radiator 104 formed overlying the dielectric layer 102. The radiator 104 has a selectable length. The length is responsive to at least one selectively connectable MEMS conductive section 106. As opposed to changing the effective electrical length of the antenna, for example by adjusting the dielectric medium, the present invention radiator 104 has a selectable mechanical length responsive to the MEMS conductive section 106. As shown, the radiator has a length represented by reference designator 108 if the MEMS 106 is engaged (closed) and a length 110 if the MEMS conductive section 106 is not engaged (open).

For example, it can be noted that the radiator 104 has a first selectable length 108 formed in response to connecting a first MEMS conductive section 106. The radiator 104 has a second length 110, shorter than the first length 108, formed in response to disconnecting the first MEMS conductive section 106. The radiator first length 108 is an effective quarter-wavelength odd multiple at a first frequency and the radiator second length 110 is an effective quarter-wavelength odd multiple at a second frequency.

Figure 2:
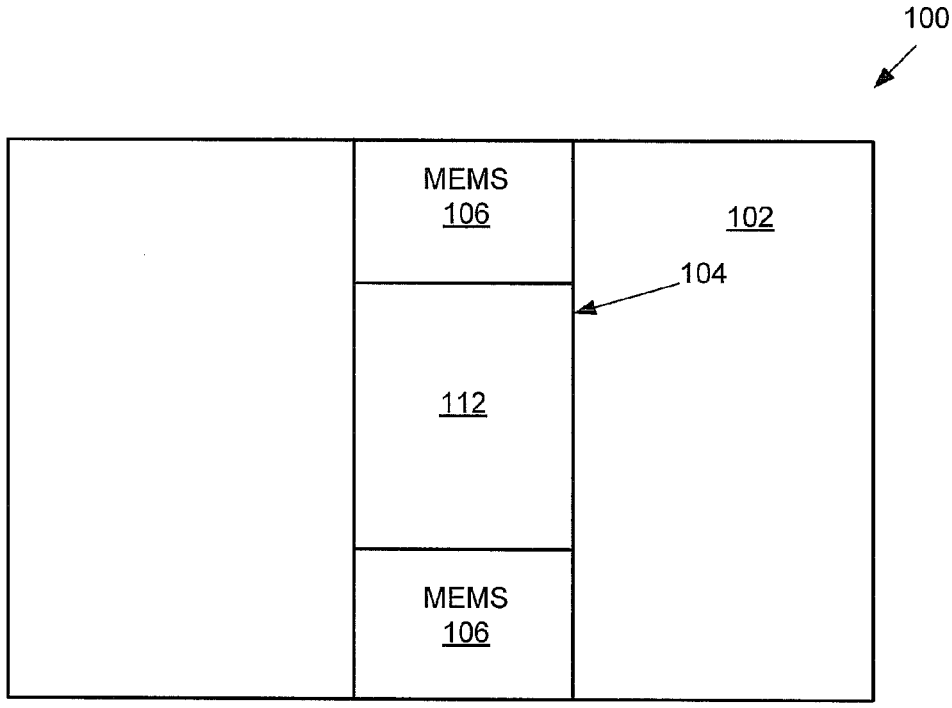
FIG. 2 is a variation of the MEMS antenna of FIG. 1 with a plurality of MEMS conductive sections.

FIG. 2 is a variation of the MEMS antenna 100 of FIG. 1 with a plurality of MEMS conductive sections. That is, the radiator 104 may include a plurality of selectively connectable MEMS conductive sections. Two MEMS conductive sections 106 are shown. Viewing either FIG. 1 or 2, the radiator 104 may include at least one fixed-length conductive section 112. As shown in FIG. 2, the radiator 104 may include a fixed-length conductive section 112 and a plurality of MEMS conductive sections 106.

Figure 3:
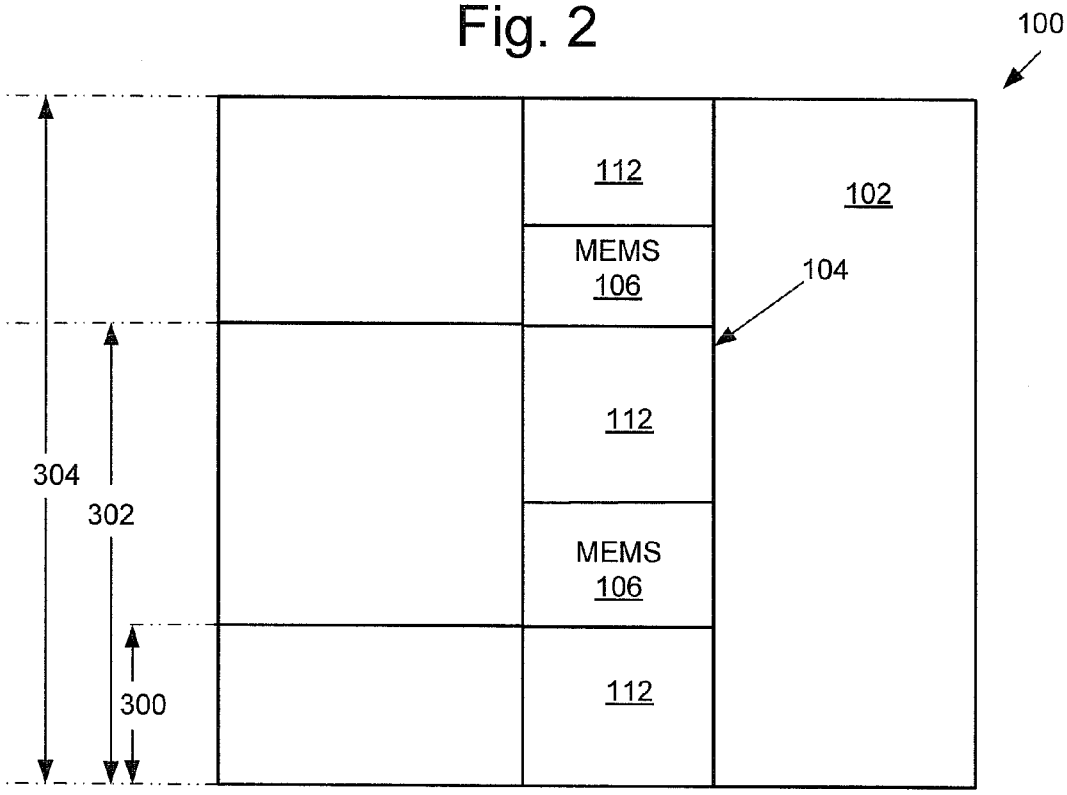
FIG. 3 is a variation of the MEMS antenna featuring a radiator with a plurality of fixed-length conductive sections and a plurality of MEMS conductive sections.

FIG. 3 is a variation of the MEMS antenna 100 featuring a radiator 104 with a plurality of fixed-length conductive sections 112 and a plurality of MEMS conductive sections 106. The present invention is not limited to any particular length of fixed length conductive section or any length of MEMS conductive sections.

For example, the radiator may have a first plurality of selectable lengths 300, 302, and 304 formed in response to selectively connecting a second plurality of MEMS conductive sections 106. In this example, the first plurality is equal to three and the second plurality is equal to two. Then, the radiator 104 has a first plurality (three) of selectable effective quarter-wavelength odd multiple lengths to communicate a first plurality of frequencies. That is, a wavelength of $(2n+1)(\lambda/4)$, where $n=0, 1, 2, \ldots$. For use in a wireless telephone, the radiator 104 may communicate at frequencies such as 824 to 894 megahertz (MHz) for cell, 1850 to 1990 MHz for PCS, 1565 to 1585 MHz for GPS, and 2400 to 2480 MHz for Bluetooth.

Viewing FIGS. 1, 2, or 3, the radiator 104 is shown with a fixed-length conductive section 112 in series with a MEMS conductive section 106. Or as seen in FIG. 2, the radiator includes a fixed-length conductive section 112 in series with a plurality of MEMS conductive sections 106. As seen in FIG. 3, the radiator 104 can include a plurality of fixed-length conductive sections 112 in series with a plurality of MEMS conductive sections 106.

Figure 4:
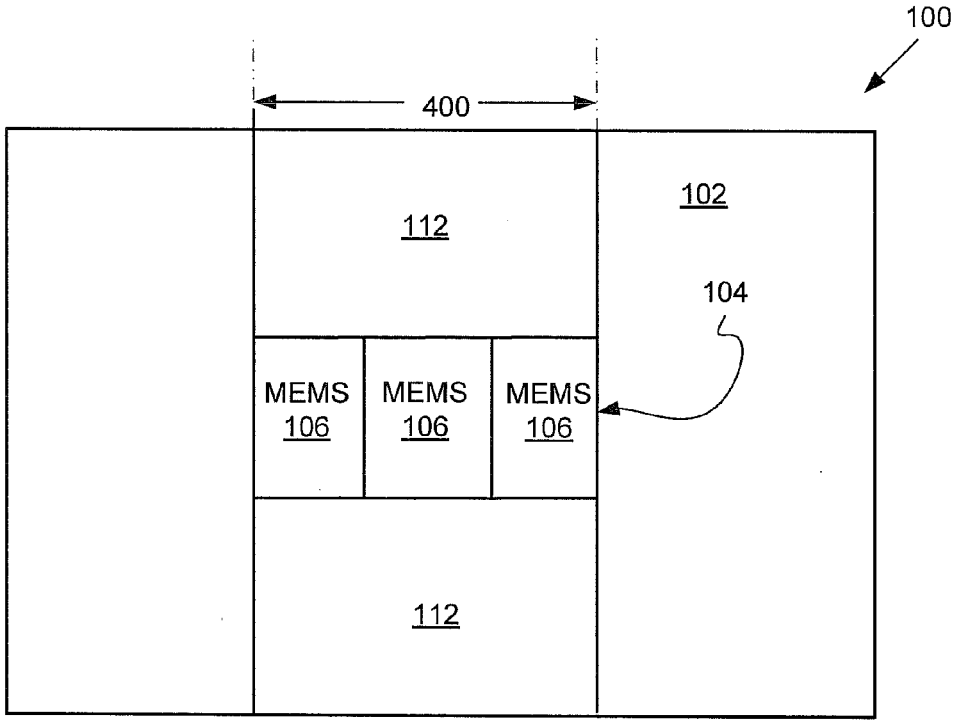
FIG. 4 depicts a version of the present invention antenna where the radiator has a width and includes a plurality of MEMS conductive sections parallely aligned along the radiator width.

FIG. 4 depicts a version of the present invention antenna where the radiator 104 has a width 400 and includes a plurality of MEMS conductive sections 106 parallely aligned along the radiator width 400. Although three MEMS conductive sections are shown, the invention is not limited to any particular number of parallely aligned MEMS conductive sections.

Figure 5:
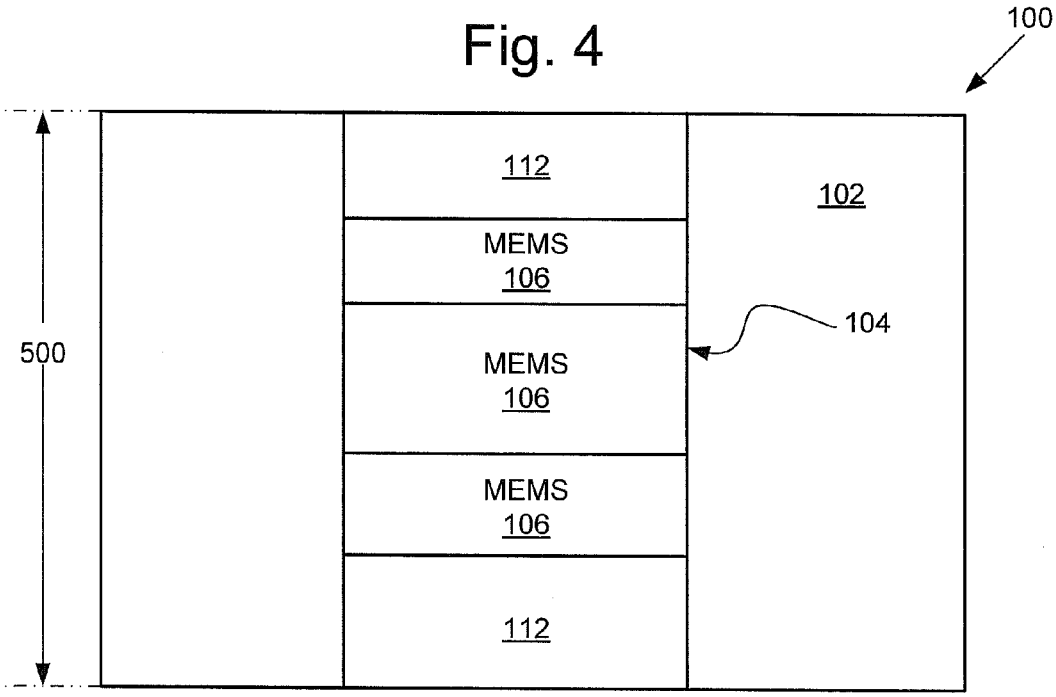
FIG. 5 depicts a version of the present invention antenna where the radiator includes a plurality of MEMS conductive sections parallely aligned along the radiator length.

FIG. 5 depicts a version of the present invention antenna where the radiator 104 includes a plurality of MEMS conductive sections 106 parallely aligned along the radiator length 500.

Figure 6:
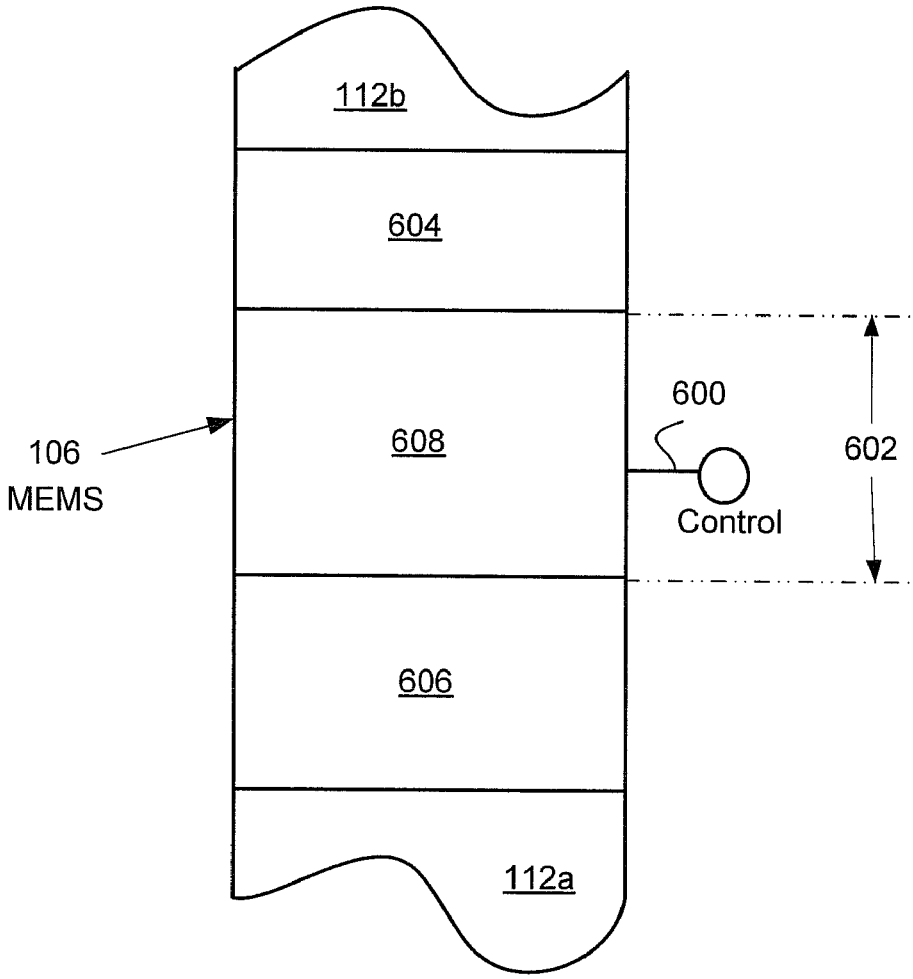
FIG. 6 is a more detailed depiction of a MEMS conductive section.

FIG. 6 is a more detailed depiction of a MEMS conductive section 106. The MEMS conductive section 106 has a control input on line 600, a signal input at connected to a first radiator conductive section 112*a*, and a signal output connected to a second radiator section 112*b*. The signal output is selectively connected to the signal input in response to the control signal.

The MEMS device can be considered a conductive section with a length represented by reference designator 602 when closed. As shown, the MEMS device has fixed length sections 604 and 606 that can be considered to be part of a connected fixed-length conductive section, even when the MEMS device is open. However, in some aspects of the invention the lengths represented by 604 and 606 can be zero. Alternately stated, the length of the MEMS device can be a result of only the switched section 608, or a combination of the switched section 608, with fixed-length sections 604 and 606.

Figure 7:
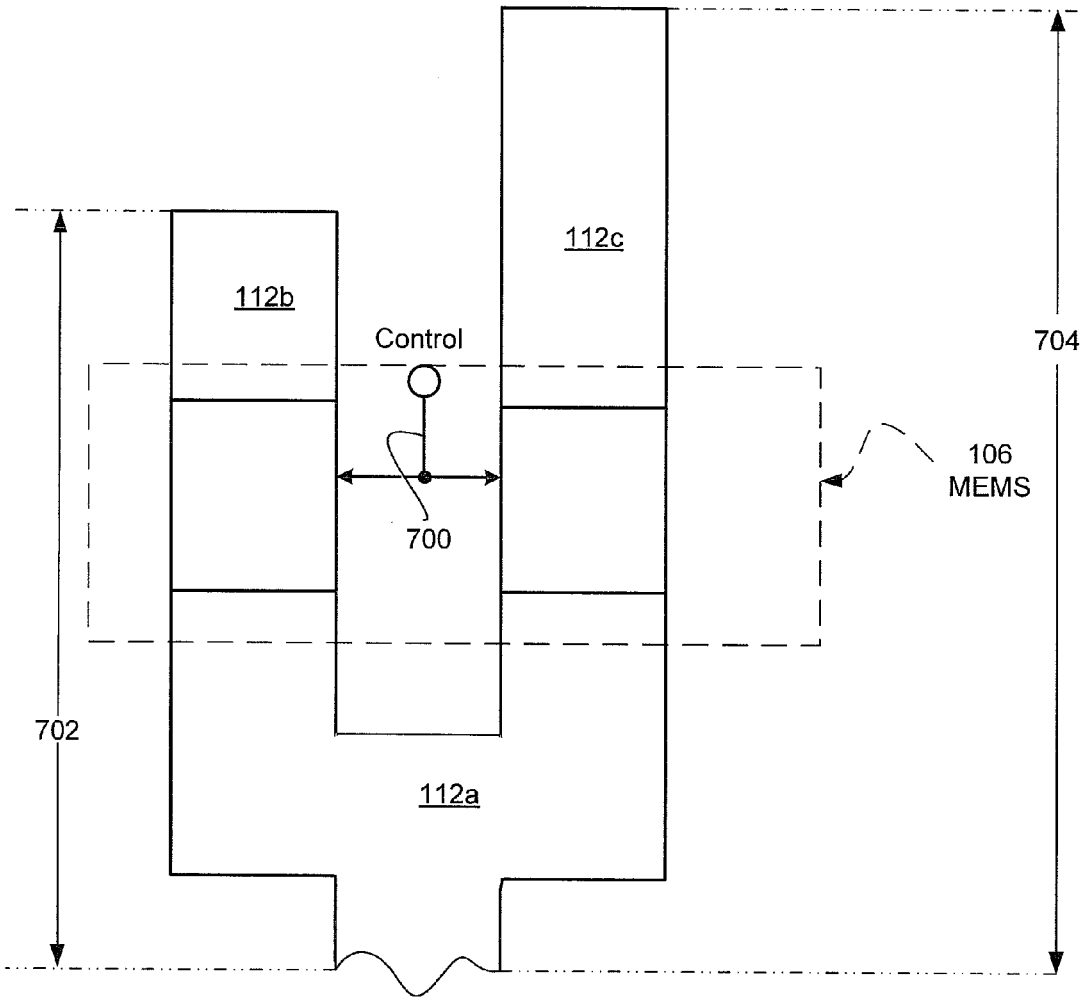
FIG. 7 is a depiction of a variation of the MEMS conductive section of FIG. 6.

FIG. 7 is a depiction of a variation of the MEMS conductive section 106 of FIG. 6. The MEMS conductive section 106, shown surrounded by dotted lines, has a control input 700, a signal input connected to a first radiator conductive section 112*a*, and a plurality of signal outputs connected to corresponding plurality of radiator sections. One of the signal outputs is selectively connected to the signal input in response to the control signal on line 700. The radiator has a plurality of selectable lengths corresponding to the MEMS signal outputs.

As specifically shown, the plurality equals two, so that MEMS conductive section has a first signal output connected to a second radiator section 112*b* and a second signal output connected to a third radiator section 112*c*. Then, the radiator 104 has a first length 702 in response to connecting the radiator first and second radiator sections through the MEMS conductive section 106, and a second length 704 responsive to connecting the radiator first and third radiator sections through the MEMS conductive section. Although a two signal output MEMS device is shown, it should be understood that the present invention is not limited to any particular number of MEMS signal outputs.

Figure 8:
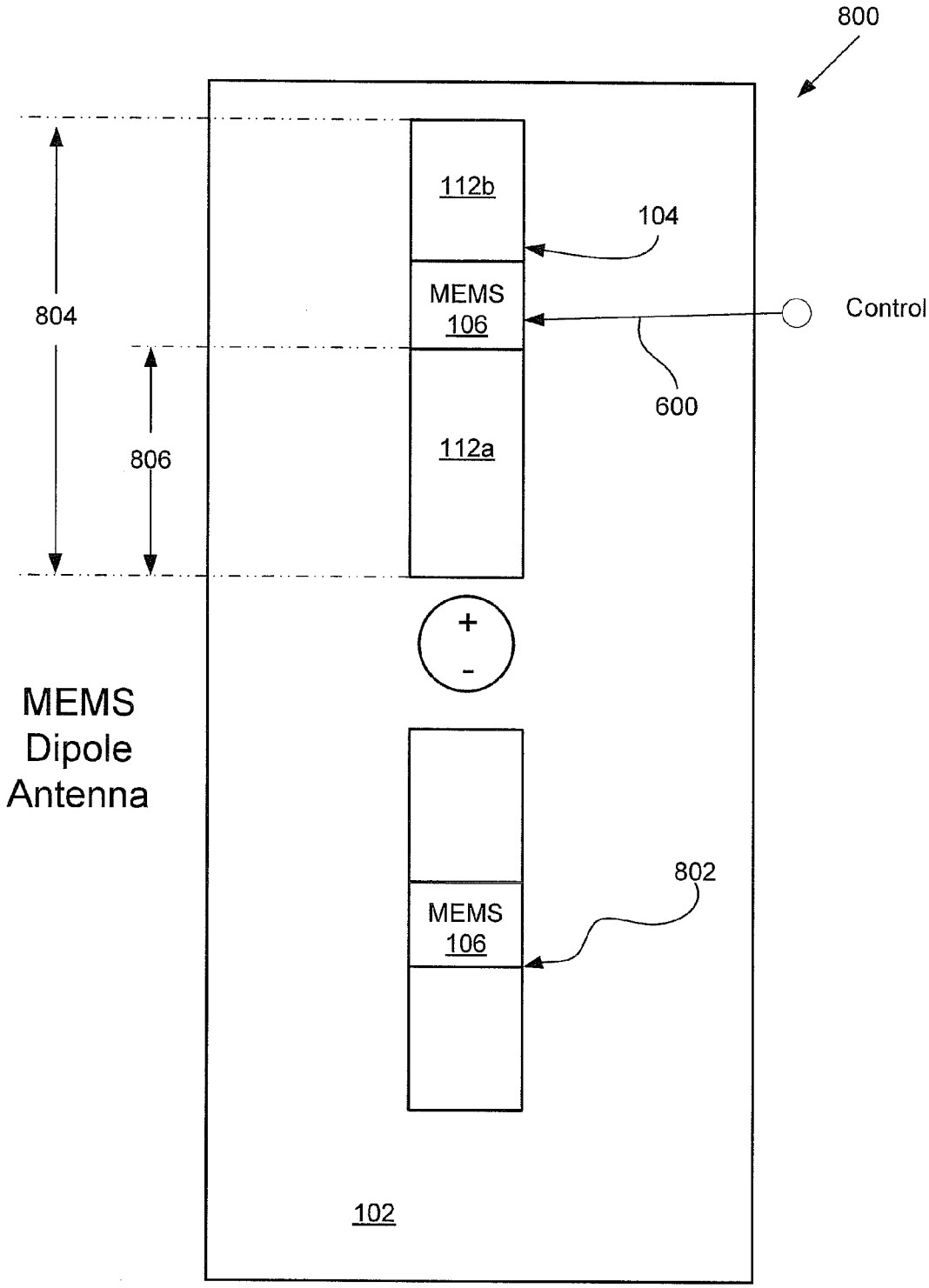
FIG. 8 is a plan view of the present invention MEMS dipole antenna.

FIG. 8 is a plan view of the present invention MEMS dipole antenna 800. The MEMS dipole antenna 800 comprises a radiator 104 formed from a conductive line on a dielectric layer 102 and a counterpoise 802. At least one MEMS conductive section 106 is included. As shown, the radiator 104 includes a MEMS conductive section 106, making the radiator length selectable, responsive to the MEMS conductive section 106. Typically, if the radiator includes a MEMS conductive section, then the counterpoise 802 will be conductive line formed on a dielectric layer 102 (or a different board) and also include a MEMS conductive section 106. The counterpoise 802 has a selectable length, responsive to the MEMS conductive section 106, that matches the selectable length of the radiator 104. Likewise, although the following discussion tends to focus on just the dipole radiator, it should be understood that in many instances, the counterpoise is identical to the radiator. As shown, the radiator 104 includes a fixed-length conductive section 112 and a MEMS conductive section 106.

The radiator 104 has a first selectable length 804 formed in response to connecting a first MEMS conductive section 106, and a second length 806, shorter than the first length 804, formed in response to disconnecting the first MEMS conductive section 106. The radiator first length 804 is an effective quarter-wavelength odd multiple at a first frequency, and the radiator second length 806 is an effective quarter-wavelength odd multiple at a second frequency.

Contrasting FIG. 8 with FIG. 6, the MEMS conductive section 106 has a control input 600, a signal input connected to a first radiator conductive section 112*a*, and a signal output connected to a second radiator section 112*b*. The signal output is selectively connected to the signal input in response to the control signal 600. The radiator first length 804 is formed in response to connecting the first radiator conductive section 112*a* to the second radiator conductive section 112*b*. The radiator second length 806 is formed in response to disconnecting the first radiator conductive section 112*a* from the second radiator conductive section 112*b*.

Figure 9:
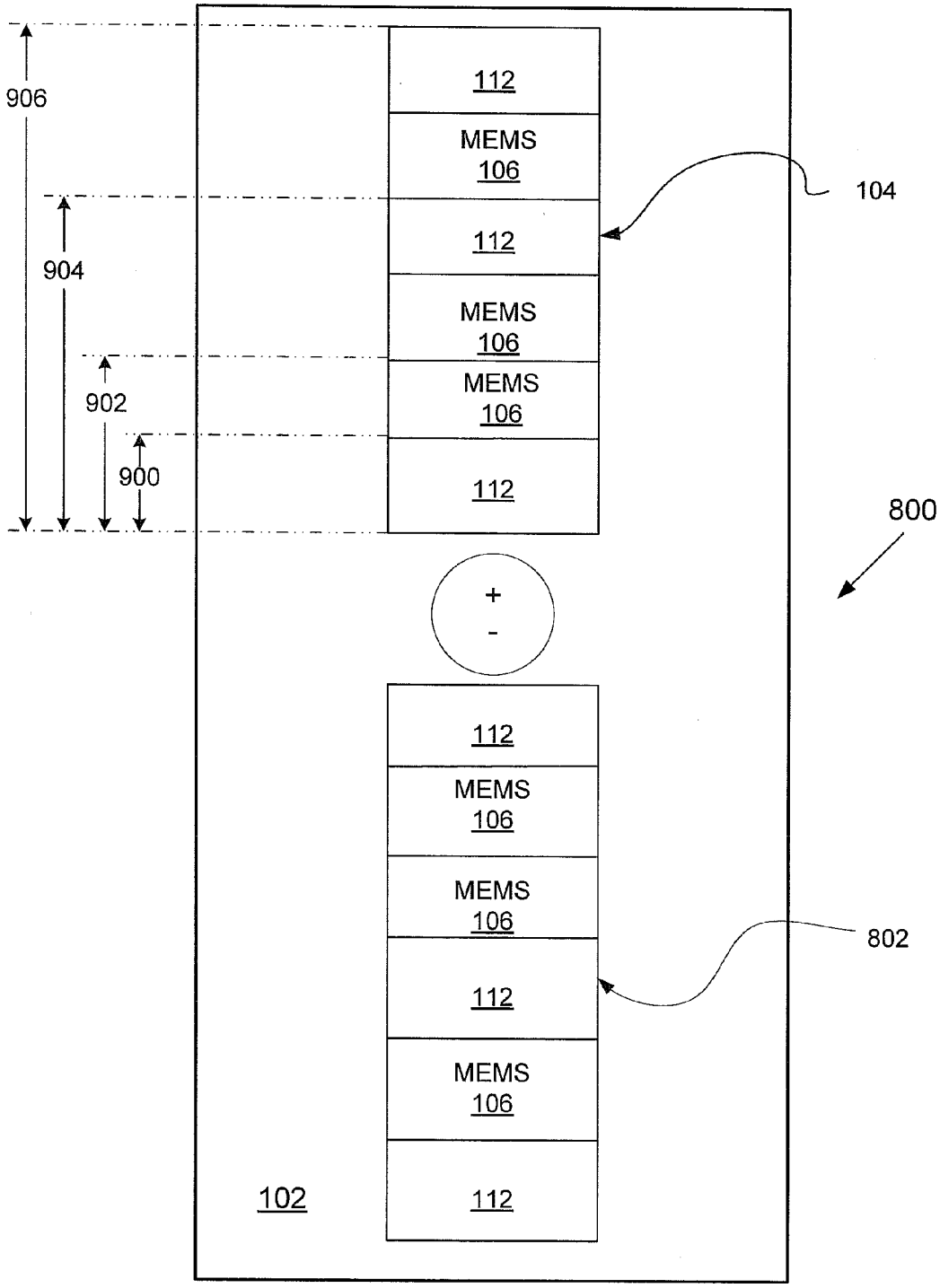
FIG. 9 depicts a MEMS dipole antenna where the radiator (and counterpoise) includes a plurality of MEMS conductive sections.

FIG. 9 depicts a MEMS dipole antenna where the radiator 104 (and counterpoise 802) includes a plurality of MEMS conductive sections 106. The radiator 104 also includes a plurality of fixed-length conductive sections 112. More specifically, the radiator 104 includes a fixed-length conductive section 112 in series With a MEMS conductive section 106.

Thus, the radiator 104 has a first plurality of selectable lengths (900, 902, 904, and 906) formed in response to selectively connecting a second plurality of MEMS conductive sections. In this example the first plurality is equal to four and the second plurality is equal to three. Then, the radiator 104 has a first plurality (four) of selectable effective quarter-wavelength odd multiple lengths to communicate a first plurality of frequencies. If the antenna 800 is used in a wireless telephone, the radiator may communicate at frequencies such as 824 to 894 MHz, 1850 to 1990 MHz, 1565 to 1585 MHz, and 2400 to 2480 MHz.

Figure 10:
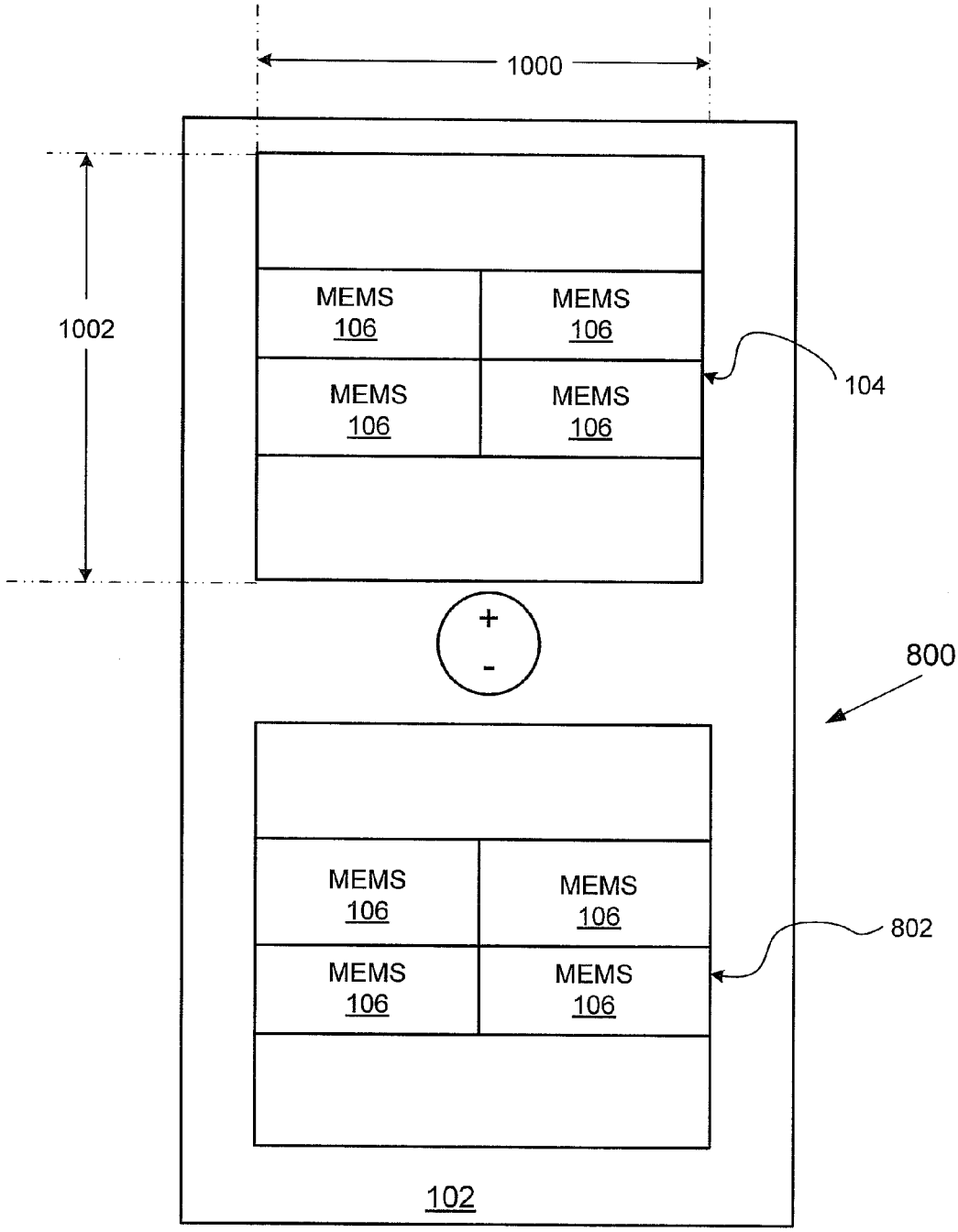
FIG. 10 is a depiction of another MEMS dipole antenna variation.

FIG. 10 is a depiction of another MEMS dipole antenna variation. The radiator 104 has a width 1000 and includes a plurality of MEMS conductive sections 106 parallely aligned along the radiator width. Two MEMS sections 106 are shown aligned along the width 1000, but the invention is not limited to any particular number. Likewise, the radiator 104 includes a plurality of MEMS conductive sections 106 parallely aligned along the radiator length 1002. Two MEMS sections 106 are shown aligned along the length 1002, but the invention is not limited to any particular number. Note that MEMS conductive sections need not necessarily be aligned along both the width and the length, as a contrast see FIGS. 4 and 5.

Figure 11:
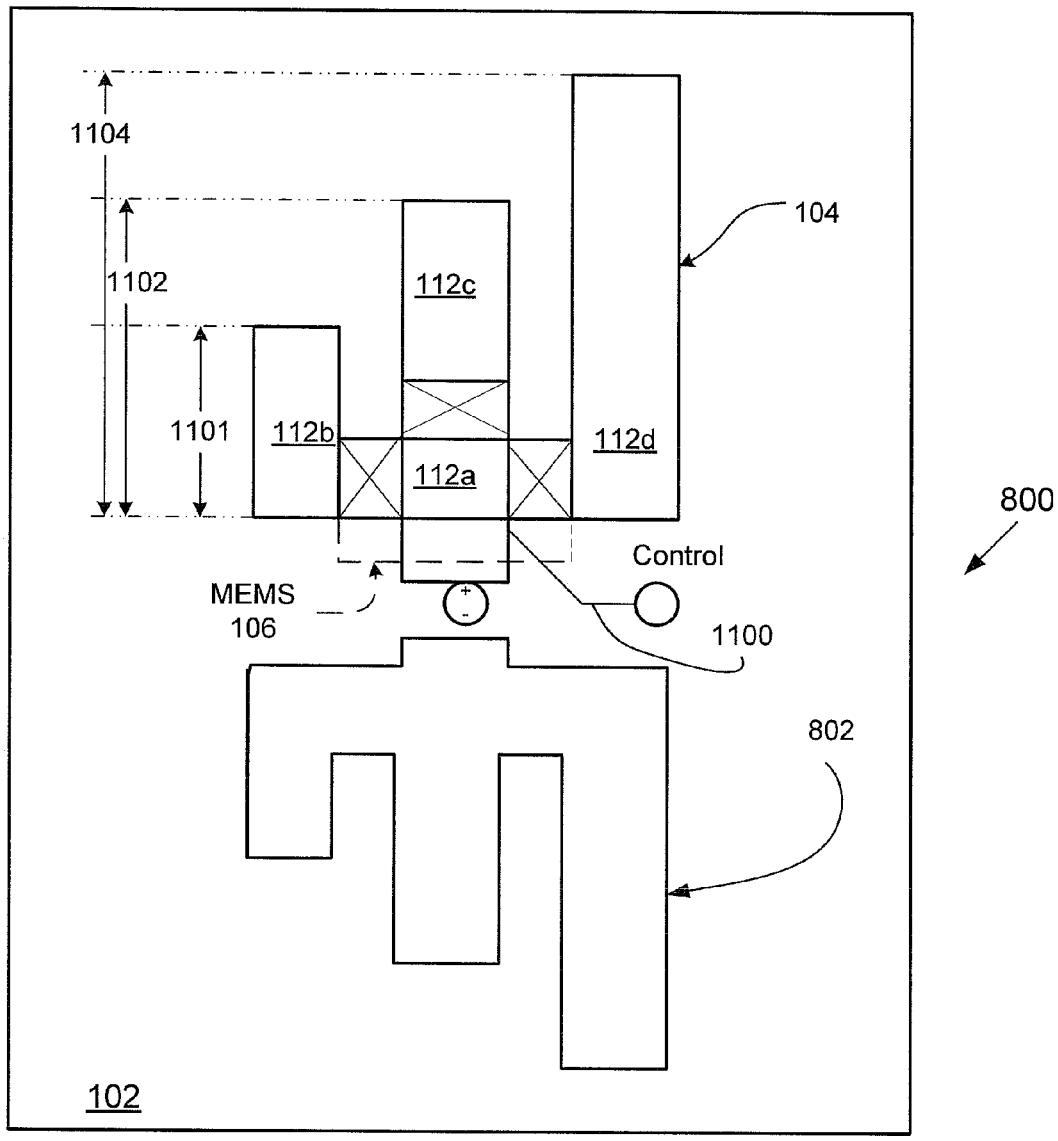
FIG. 11 is a depiction of a MEMS dipole antenna using a multi-throw MEMS conductive section.

FIG. 11 is a depiction of a MEMS dipole antenna using a multi-throw MEMS conductive section 106. The MEMS conductive section has a control signal input on line 1100, a signal input connected to a first radiator conductive section, and a plurality of signal outputs connected to corresponding plurality of radiator conductive sections (112*b*, 112*c*, and 112*d*). One of the signal outputs is selectively connected to the signal input in response to the control signal on line 700. The switching (physically moveable) sections of the MEMS device 106 are designated with "X" symbols. The radiator 104 has a plurality of selectable lengths corresponding to the MEMS signal outputs.

For example, if the MEMS conductive section has two signal outputs, the radiator can have a first length 1101 responsive to connecting the radiator first and second radiator sections 112*a* and 112*b* through the MEMS conductive section 106. A second length 1102 is responsive to connecting the radiator first and third radiator sections 112*a* and 112*c* through the MEMS conductive section. Likewise, a third length 1104 can be formed by connecting fixed-length sections 112*a* to 112*d*.

Figure 12A:
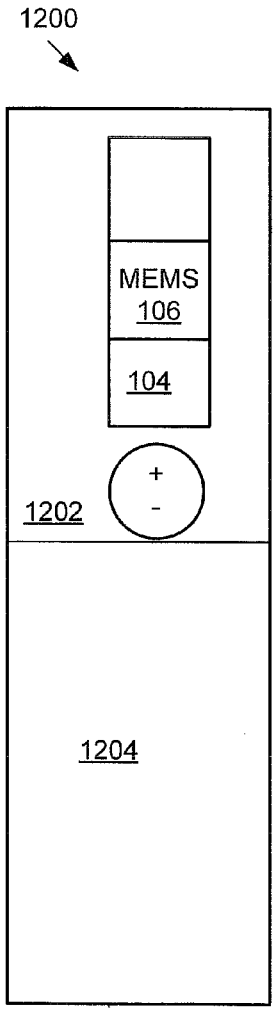
FIGS. 12*a* through 12*c* are plan views depicting different aspects of the present invention monopole antenna.
Figure 12B:
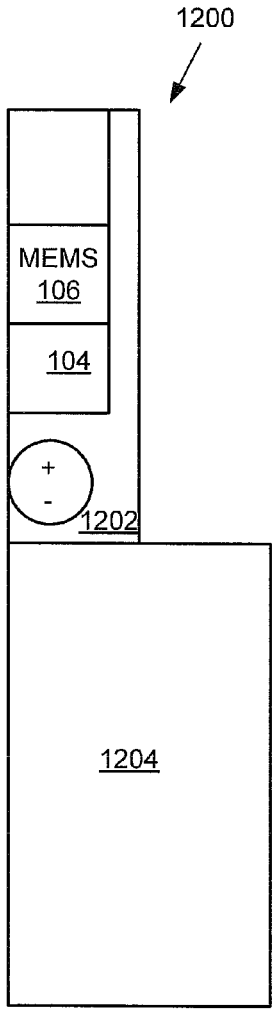
Figure 12C:
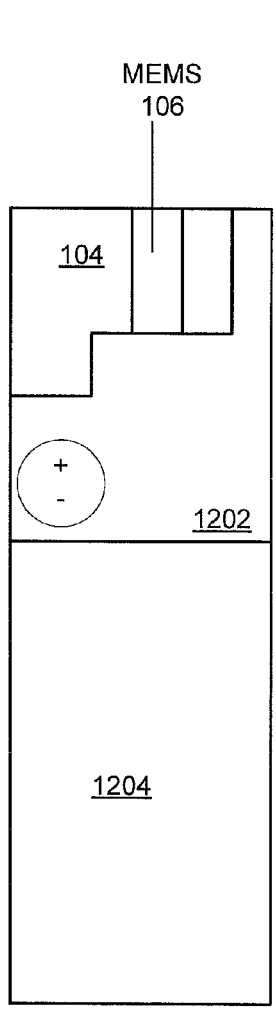

FIGS. 12*a* through 12*c* are plan views depicting different aspects of the present invention monopole antenna 1200. As described above in the explanation of the dipole antenna, the radiator 104 is formed from a conductive line on a dielectric layer 1202, and includes at least one MEMS conductive section 106. A groundplane counterpoise 1204 is proximately located with the radiator 104.

Apart from the differences in the counterpoise, the MEMS dipole and MEMS monopole antennas are very similar. Unlike the MEMS dipole counterpoise, the MEMS monopole remains constant, even as the radiator length changes. Therefore, the explanation of the MEMS monopole antenna radiator is substantially the same as the explanation of the MEMS dipole antenna radiator, and will not be repeated in the interest of brevity.

Figure 13:
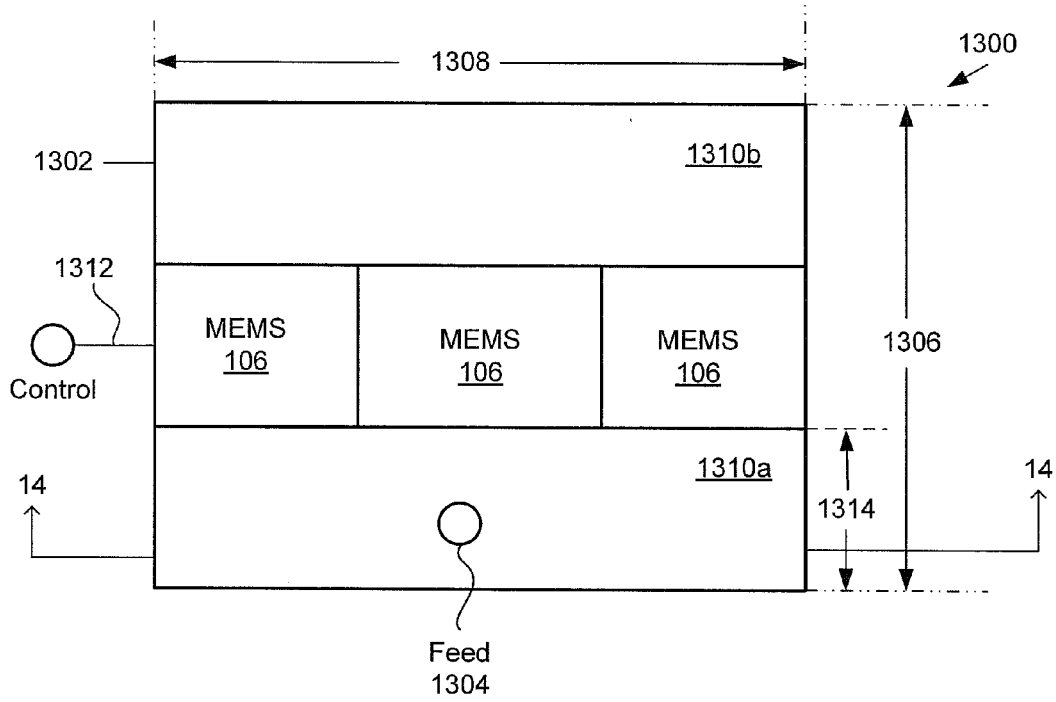
FIG. 13 is a plan view of the present invention MEMS patch antenna.

FIG. 13 is a plan view of the present invention MEMS patch antenna. The MEMS patch antenna 1300 comprises a patch radiator 1302 formed from a conductor overlying a dielectric layer (not shown) and including at least one MEMS conductive section 106. A feed 1304 connects the radiator 1302 to a transmission line (not shown).

Figure 14:
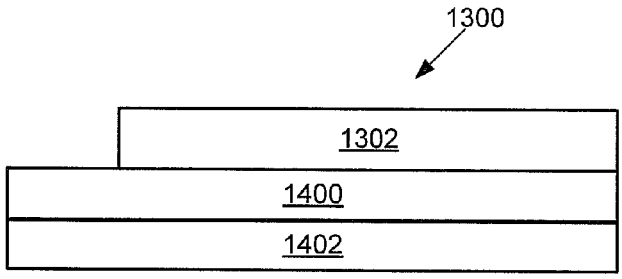
FIG. 14 is a partial cross-sectional view of the patch antenna of FIG. 13.

FIG. 14 is a partial cross-sectional view of the patch antenna 1300 of FIG. 13. The radiator 1302 is shown, with the dielectric layer 1400 underlying the radiator 1302, and a groundplane 1402 underlying the dielectric layer 1400.

Returning to FIG. 13, the radiator 1302 has a selectable size responsive to the MEMS conductive sections. The size of the radiator 1302 is generally related to the area or shape. However, since one practical radiator shape is a rectangle or square, the size will be illustrated herein as the radiator length 1306 times the radiator width 1308.

As shown, the radiator 1302 typically includes a fixed-size conductive section 1310. In fact, the radiator 1302 may include a plurality of fixed-size conductive sections 1310. Specifically, sections 1310*a* and 1310*b* are shown. In other aspects, as shown, the radiator 1302 includes a fixed-size conductive section 1310 in series with a MEMS conductive section 106. Also as shown, a plurality (three in this example) of MEMS conductive sections 106 are parallely aligned along the radiator width 1308.

Figure 15:
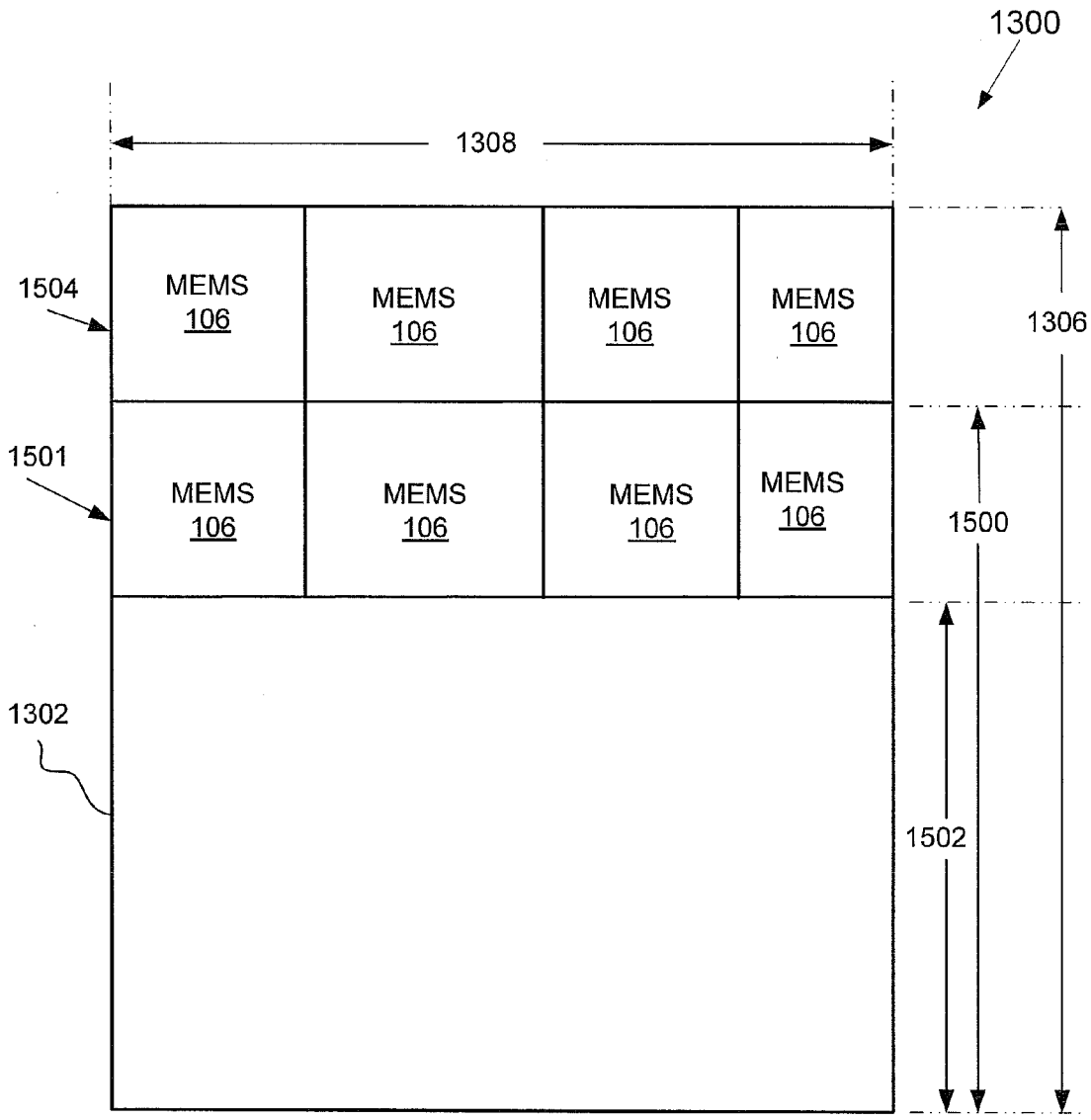
FIG. 15 is a depiction of a variation of the MEMS patch antenna of FIG. 13.

FIG. 15 is a depiction of a variation of the MEMS patch antenna 1300 of FIG. 13. As shown, a plurality of MEMS conductive sections 106, in this example two, are parallely aligned along the radiator length 1306. MEMS conductive sections 106 are also shown aligned along the radiator width 1308.

The radiator 1302 has a first selectable size, represented by length 1500 times width 1308, formed in response to connecting a first MEMS conductive section. More specifically, a bank 1501 of MEMS sections 106, aligned the width 1308, are connected. The radiator 1302 has a second size, represented by the length 1502 times width 1308, smaller than the first size, formed in response to disconnecting the first MEMS conductive section. In this case, the second size is formed in response to disconnecting the above-mentioned bank 1501 of MEMS sections 106. The radiator 1302 first size forms an effective quarter-wavelength odd multiple at a first frequency and the second size forms an effective quarter-wavelength odd multiple at a second frequency.

As shown, another bank 1504 of MEMS sections 106 aligned along width 1308 can be connected to form a third size represented by the length 1306 times the width 1308. Therefore, the radiator 1302 has a first plurality of selectable sizes, in this example three, formed in response to selectively connecting a second plurality of MEMS conductive sections 106. In this example, the second plurality is equal to eight. Then, the radiator 1302 has a first plurality (three) of selectable effective quarter-wavelength odd multiple lengths to communicate at a first plurality of frequencies. As noted above, some frequency bands of interest in wireless telephone embodiments of the present invention antenna include 824 to 894 MHz, 1850 to 1990 MHz, 1565 to 1585 MHz, and 2400 to 2480 MHz.

Contrasting FIGS. 6 and 13, it should-be understood that each MEMS conductive section has a control input on line 1312 (600 in FIG. 6), a signal input connected to a first radiator conductive section 1310*a*, and a signal output connected to a second radiator section 1310*b*. The signal output is selectively connected to the signal input in response to the control signal on line 1312. The radiator has a first size, represented by length 1306, formed in response to connecting the first radiator conductive section 1310*a* to the second radiator conductive section 1310*b*. The radiator 1302 has a second size, represented by length 1314, smaller than the first size, formed in response to disconnecting the first radiator conductive section 1310*a* from the second radiator conductive section 1310*b*.

Figure 16:
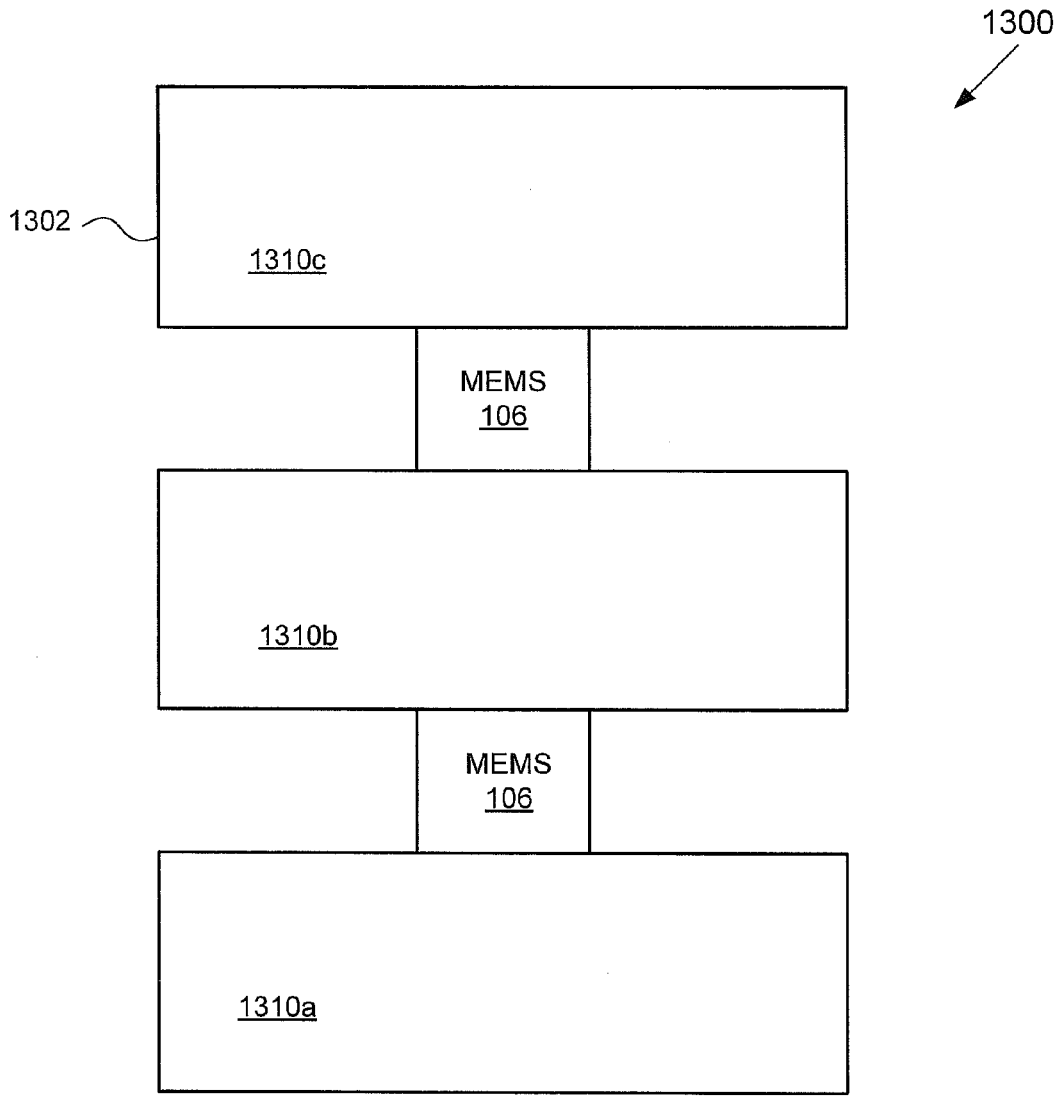
FIG. 16 is a plan view depiction of another variation of the MEMS patch antenna.

FIG. 16 is a plan view depiction of another variation of the MEMS patch antenna 1300. As shown, the radiator 1302 includes a first fixed-size conductive section 1310*a*, a second fixed-size conductive section 1310*b*, and a MEMS conductive section 106 selectively connecting the first fixed-size conductive section 1310*a* to the second fixed-size conductive section 1310*b*.

More generally, the radiator 1302 may include a first plurality of fixed-size conductive sections (1310*a*, 1310*b*, and 1310*c*). In this example, the first plurality equals three. A second plurality of MEMS conductive sections 106 selectively connects the fixed-size conductive sections 1310*a*, 1310*b*, and 1310*c*. In this example the second plurality equals two. Although each fixed-size section is shown connected with a single MEMS section 106, in other aspects additional MEMS sections may be aligned along the radiator width 1500 and/or along the radiator length 1502, so that the antenna comes closer to resembling the variations shown in FIG. 13 or 15.

Figure 17:
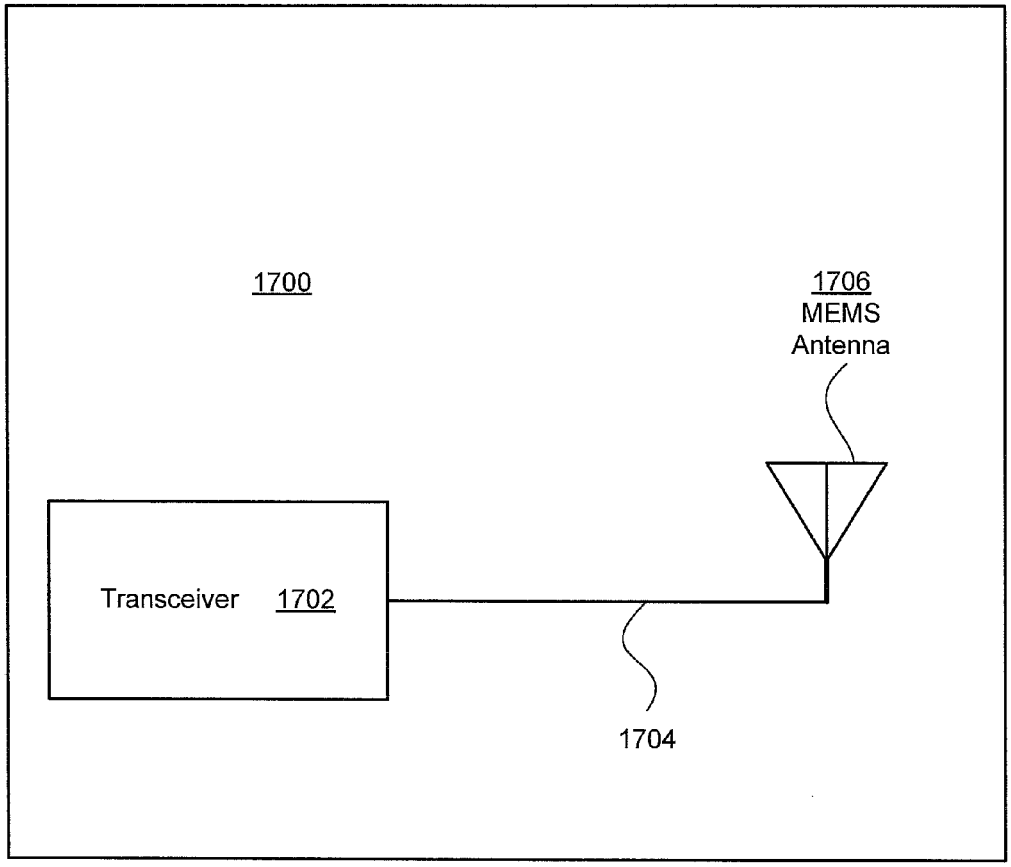
FIG. 17 is a schematic block diagram of a present invention wireless telephone communications device.

FIG. 17 is a schematic block diagram of a present invention wireless telephone communications device 1700. The wireless device 1700 comprises a transceiver 1702 with an antenna port on line 1704. The transceiver 1702 can be a telephone transceiver, GPS receiver, or Bluetooth transceiver to name a few examples. A selectable length microstrip antenna 1706, including at least one selectively connectable MEMS conductive section, has a transmission line interface connected to the transceiver antenna port on line 1704. The antenna 1706 can be a MEMS dipole, MEMS monopole, MEMS patch antenna as described in detail above, or any other type of antenna that uses a MEMS to vary the length of the radiator. As noted above, some frequency bands of interest in wireless telephone embodiments of the present invention antenna include 824 to 894 MHz, 1850 to 1990 MHz, 1565 to 1585 MHz, and 2400 to 2480 MHz.

Figure 18:
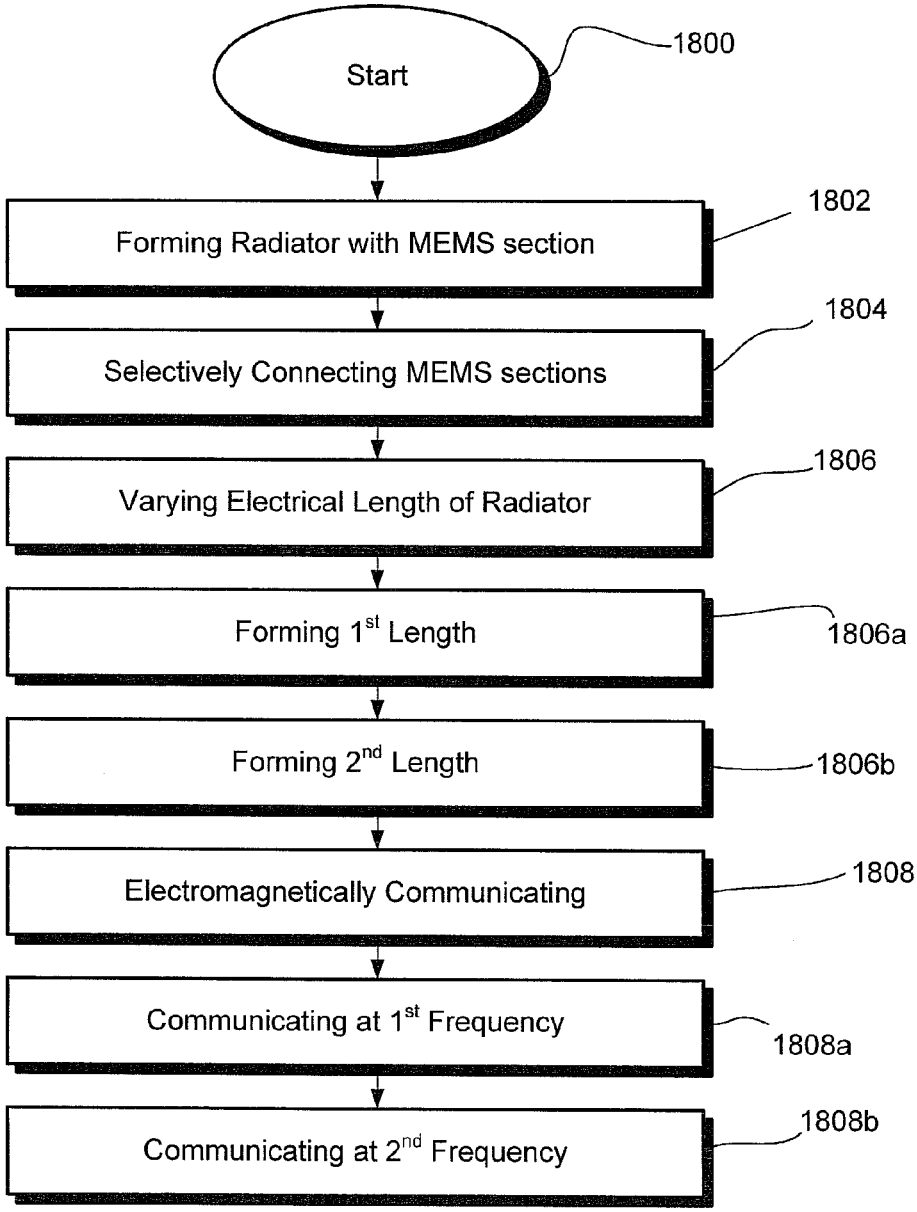
FIG. 18 is a flowchart illustrating the present invention method for selecting an antenna length.
Figure 19:
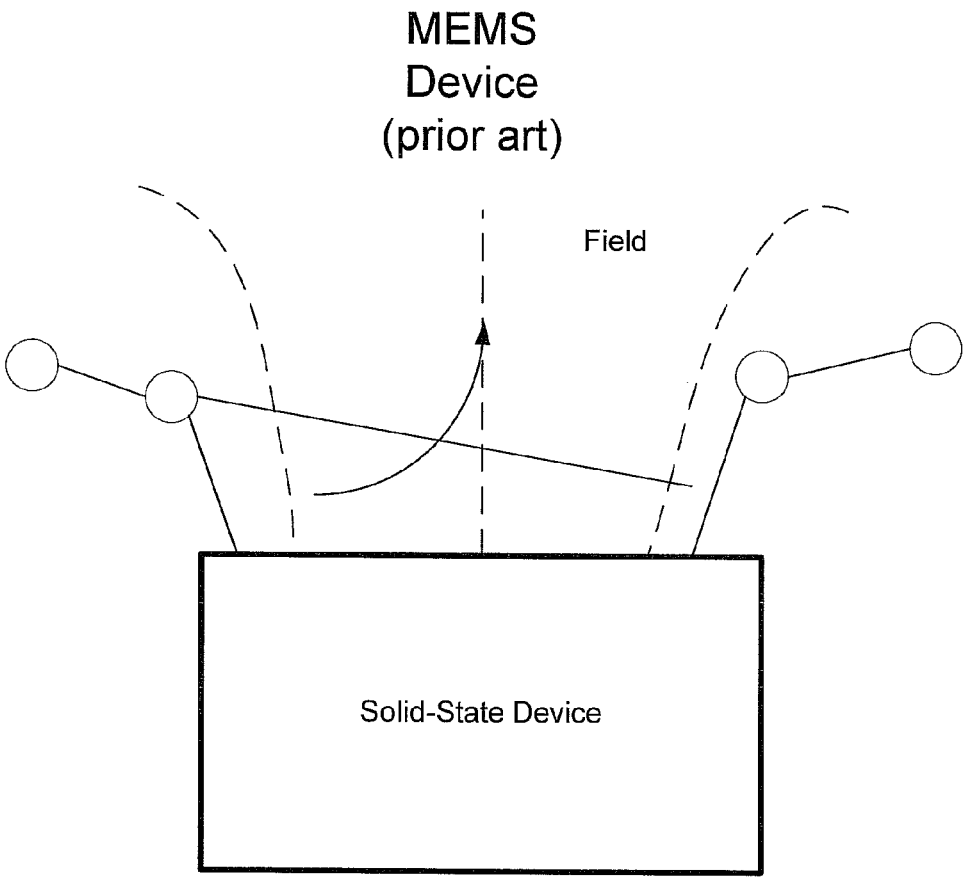
FIG. 19 is a schematic diagram of a microelectromechanical switch (MEMS) (prior art).

FIG. 18 is a flowchart illustrating the present invention method for selecting an antenna length. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The methods start at Step 1800. Step 1802 forms a radiator with at least one microelectromechanical switch (MEMS) conductive section. Step 1804 selectively connects the MEMS conductive sections. Step 1806 varies the electrical length of the radiator in response to the connected MEMS conductive sections. In some aspects, Step 1806 varies the physical (mechanical) length of the radiator in response to connecting MEMS conductive sections.

In some aspects of the method, Step 1808 electromagnetically communicates at a frequency responsive to the physical length of the radiator. For example, electromagnetically communicating at a frequency responsive to the physical length of the radiator includes communicating at a frequency selected from the group including 824 to 894 megahertz (MHz), 1850 to 1990 MHz, 1565 to 1585 MHz, and 2400 to 2480 MHz.

In other aspects, varying the electrical length of the radiator in response to the connected MEMS conductive sections includes substeps. Step 1806*a* forms a first length in response to connecting a first MEMS conductive section. Step 1806*b* forms a second length in response to disconnecting the first MEMS conductive section. Then, Step 1808*a* would electromagnetically communicate at a first frequency responsive to the first length of the radiator and Step 1808*b* would electromagnetically communicate at a second frequency responsive to the second length of the radiator.

In some aspects, varying the electrical length of the radiator in response to the connected MEMS conductive sections in. Step 1806 includes forming a first plurality of selectable lengths in response to selectively connecting a second plurality of MEMS conductive sections. Then, Step 1808 electromagnetically communicates at one of a first plurality of frequencies is response to forming one of the first plurality of selectable lengths of radiator.

A MEMS antenna has been provided. Various examples of dipole, monopole, and patch MEMS antenna have been given. However, these examples only represent a limited number of ways that a MEMS section may be used to vary the physical length of an antenna radiator. Likewise, the invention is not merely limited to the general antenna types used in the examples, as the general concept can be applied to any antenna radiator. Although the MEMS conductive sections have been shown as having either a square or rectangular shape, it should be understood that an antenna radiator could be built using a MEMS conductive section having a different form. Other variations and embodiments of the invention will occur to those skilled in the art.

I claim:

1. A microelectromechanical switch (MEMS) dipole antenna comprising:

a dielectric layer;

a conductive line radiator formed overlying the dielectric layer comprising a first selectively connectable MEMS and a second selectively connectable MEMS;

a conductive line counterpoise formed overlying the dielectric layer comprising a third selectively connectable MEMS and a fourth selectively connectable MEMS; and wherein the first MEMS is connected to the second MEMS without an intervening fixed length conductive section, wherein the third MEMS is connected to the fourth MEMS without an intervening fixed length conductive section.

2. The MEMS antenna of claim 1 wherein the radiator has a mechanical length and an effective electrical length responsive to engaging a MEMS.

3. The MEMS antenna of claim 2 wherein the radiator has a mechanical width, orthogonal to the length, responsive to engaging a MEMS.

4. The MEMS antenna of claim 1 wherein the radiator has:

a mechanical length and an effective electrical length; and a mechanical width, orthogonal to the length, responsive to engaging a MEMS.

5. The MEMS antenna of claim 1 wherein the radiator has a first length formed in response to connecting the first MEMS to the second MEMS; and wherein the radiator has a second length, shorter than the first length, formed in response to disconnecting the first MEMS from the second MEMS.

6. The MEMS antenna of claim 1 wherein the radiator first length is an effective quarter-wavelength odd multiple at a first frequency; and wherein the radiator second length is an effective quarter-wavelength odd multiple at a second frequency.

7. The MEMS antenna of claim 1 wherein each MEMS comprises a control input, a signal input, a signal output, and a conductive armature selectively connecting the signal output to the signal input in response to the control signal.

8. The MEMS antenna of claim 7 wherein each MEMS is a single pole/single throw switch.

9. The MEMS antenna of claim 1 wherein the radiator comprises at least three adjoining selectively connectable MEMS; and wherein the three MEMS are serially connectable without an intervening fixed length conductive section.

10. The MEMS antenna of claim 9 wherein the radiator has a first plurality of selectable effective quarter-wavelength odd multiple lengths to communicate at a first plurality of frequencies, responsive to engaging a plurality of MEMS.

11. A microelectromechanical switch (MEMS) antenna comprising:

a single pole/multiple throw MEMS comprising a control input to accept a control signal, a signal input, a first and a second signal output, and a first and a second conductive armature selectively connecting the signal input to the corresponding signal output in response to the control signal;

a first radiator section connected to the first MEMS signal output, the first radiator section having a first mechanical length and a first effective electrical length; and a second radiator section connected to the second MEMS signal output, the second radiator section having a second mechanical length and a second effective electrical length;

wherein the antenna has a first effective electrical length responsive to connecting the MEMS first signal output to the first radiator section, and a second effective electrical length responsive to connecting the MEMS second signal output to the second radiator section.

12. The MEMS antenna of claim 11 wherein the antenna first length is an effective quarter-wavelength odd multiple at a first frequency; and wherein the antenna second length is an effective quarter-wavelength odd multiple at a second frequency.

13. A method for selecting the electrical length of an antenna, the method comprising:

forming a radiator comprising a first microelectromechanical switch (MEMS) and a second MEMS, wherein the first MEMS adjoins the second MEMS without an intervening fixed length conductive section;

selectively connecting the first MEMS to the second MEMS; and varying the effective electrical length of the radiator in response to connecting the first and second MEMS.

14. The method of claim 13 wherein varying the effective electrical length of the radiator in response to connecting the first and second MEMS includes varying the physical length of the radiator.

* * * * *